United States Patent [19]

Wichelman

[11] Patent Number: 4,865,106

[45] Date of Patent: Sep. 12, 1989

[54] HEAT INSULATOR WINDOW SHADE

[76] Inventor: Karl F. Wichelman, P.O. Box 2000, Chico, Calif. 95927

[21] Appl. No.: 112,710

[22] Filed: Oct. 26, 1987

[51] Int. Cl.[4] ..... A47H 5/00

[52] U.S. Cl. ..... 160/84.1; 160/135; 160/368.1

[58] Field of Search ..... 160/84 R, 354, 134, 160/350, 351, 377, 372, 369, 135, 368 R

[56] References Cited

U.S. PATENT DOCUMENTS

| | | | |
|---|---|---|---|
| 1,220,888 | 3/1917 | Porter | 160/354 X |
| 1,972,539 | 9/1934 | Simpson | 160/368 X |
| 2,263,357 | 11/1941 | Hanson | 160/354 X |
| 2,911,037 | 11/1959 | Wilson | 160/229 R X |
| 4,247,599 | 1/1981 | Hopper | 160/121 R X |
| 4,531,562 | 7/1985 | Swanson | 160/26 |
| 4,582,109 | 4/1986 | Fairbanks | 160/84 R |
| 4,647,102 | 3/1987 | Ebrahimzadeh | 160/84 R X |
| 4,736,980 | 4/1988 | Eubanks | 160/370.2 |

*Primary Examiner*—Blair M. Johnson

[57] ABSTRACT

A portable reversible window shade is structured in the form of a vertically pleated substantially rectangular panel disigned for longitudinal placement on the inside of a window. A central support member is covered on one side with heat reflective material and on the other side with a heat retaining surface. The shade is provided in an easily installed, decorated one piece flat or pleated panel with provisions for adjustability in length and width.

8 Claims, 2 Drawing Sheets

HEAT INSULATOR WINDOW SHADE

BACKGROUND OF THE INVENTION

1. Field of the Invention:

This invention relates to portable window shade devices and is designed to reflect the heat during the summer and retain the heat during the winter while also providing an aesthetic appearance to the window.

2. Description of the prior art:

To my knowledge, the only item found in the market place which seemed to have a similar use and function as my invention, is the automobile shade. My invention, however, is different in design by utilizing a metallic material to reflect heat, perforations to allow the passage of filtered light, and utilizes fabric to make the invention more aesthetic. In use, the automobile shade is designed specifically for automobiles and not for home windows and does not have means for attachment one to another. I therefore feel my invention is a definite improvement over the automobile shade.

The automobile shade is patent number 4,202,396, issued to Levy of Tel Aviv in Israel on May 13, 1980.

SUMMARY OF THE INVENTION

In practicing my invention, I have developed a fold-out window shade which can be trimmed for height adjustment, two or more may be attached for length increases, and is reversible for interior heat control or reflective cooling.

Therefore, a primary objective of my invention is to provide low cost efficient heat insulating and heat reflecting capacity in a portable window shade.

Another objective of my invention is to provide a heat reflective portable window shade which is easily installed and removed.

A further objective of the invention is to provide a useful window shade which is attractive and available in a variety of patterns, textures and colors.

A still further objective of my invention is to provide a reversible window shade to change the aesthetic appearance as well as to change the shade function from heat retention to heat reflection.

Another objective of my invention is to provide window shades which are manufactured in a variety of sizes varying in width and height and have provisions for attaching the shades one to another thereby increasing their overall length.

A still further objective is to provide a second embodiment of the shade that allows partial sunlight to pass through the device by providing a multiple of small perforations through the shade panels.

Other objectives and advantages of my invention will become obvious with a reading of the specification and subsequent comparison of the numbered parts therein with similarity numbered parts provided in the drawings.

A BRIEF DESCRIPTION OF THE DRAWINGS

Figure 3:
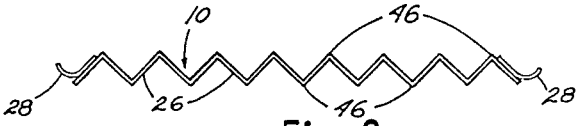

FIG. 3 in a top view of the shade partially extended with the straps attached on either end.

Figure 4:
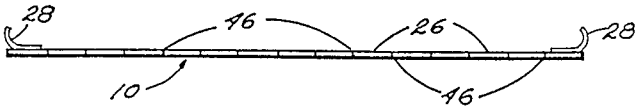

FIG. 4 shows shade in a full extended view with the straps attached to either end.

Figure 5:
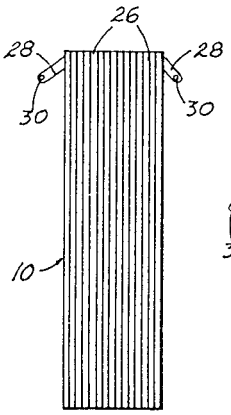

FIG. 5 shows a front view of the shade in a folded position.

Figure 6:
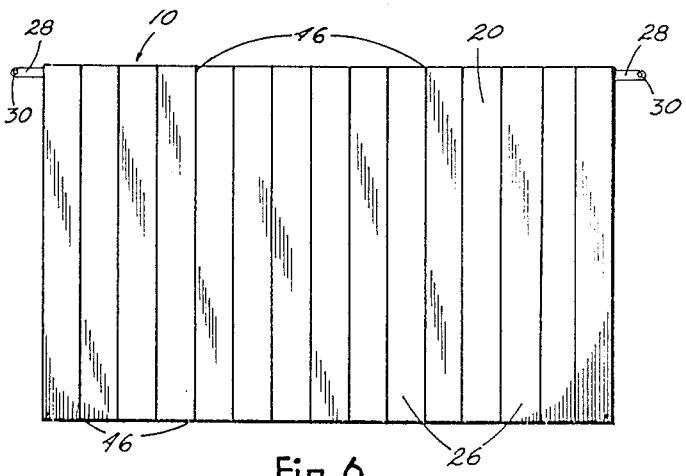

FIG. 6 shows a front view of the shade in a full extended view.

Figure 7:
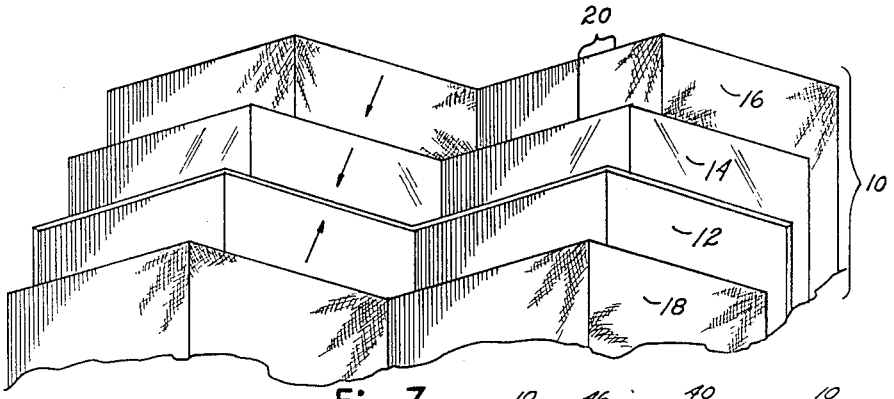

FIG. 7 shows the various layers of the shade including the porous fabric outer layer, the metallic material inner layer, which comprises the heat reflective side of the base panel and the fabric or paint layer. The arrows show the direction of attachment.

Figure 8:
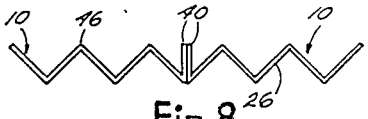

FIG. 8 shows a top view of two shades attached by using built-in snaps on the ends of the panels.

Figure 9:
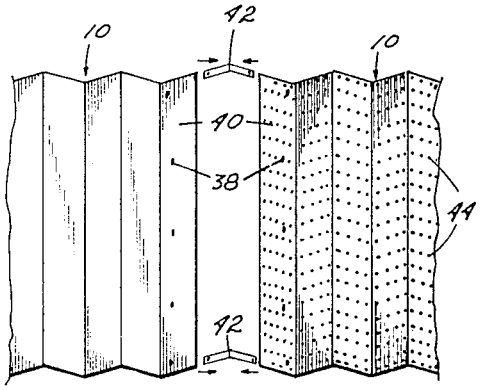

FIG. 9 shows two sections of the shade in position ready for attachment to each other by the built-in snaps and a hinge arrangement. The shade depicted on the right in the drawings shows the light perforations of the second embodiment of the invention.

Figure 10:
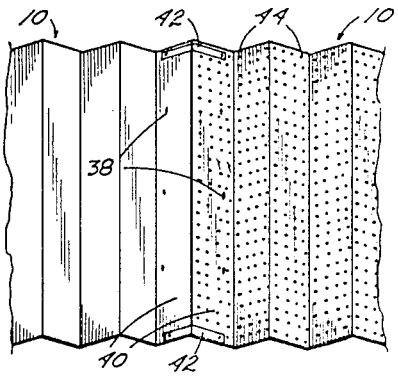

FIG. 10 shows the two shades attached using the hinges with the second embodiment of the shade on the right.

Figure 11:
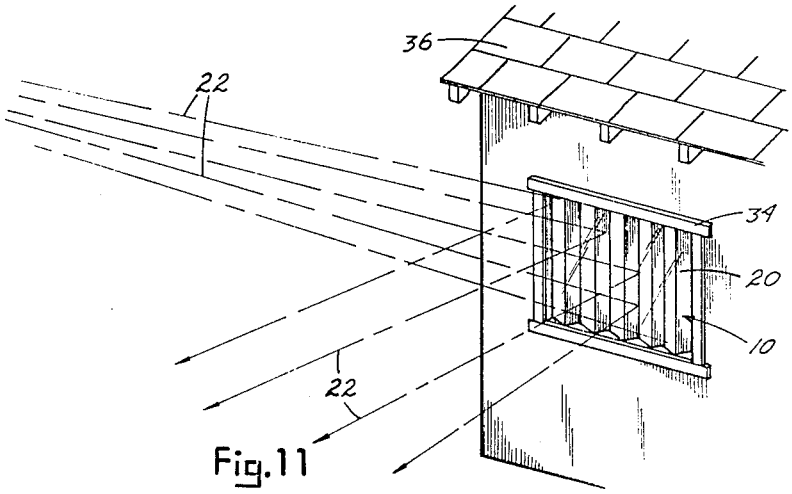

FIG. 11 shows the shade in place in a window with the heat reflective side of the shade facing to the outside and heat rays deflecting off the surface of the shade.

DRAWING REFERENCE NUMBERS

10 shade
12 base panel
14 metallic material
16 porous fabric
18 finished surface, paint or fabric
20 heat reflective side
22 heat rays
26 pleated sections
28 straps
30 eyelet
32 window hook
34 window frame
36 building
38 attachment snaps
40 panel attachment ends
42 connector hinge
44 light perforations
46 fold hinge

DESCRIPTION OF THE PREFERRED EMBODIMENT

Referring now to the drawings and the numbered parts thereon.

In FIG. 7 on page 2 of the drawings, the layer structure making up the assemblage of the invention, shade 10, is illustrated. FIG. 7 shows porous fabric 16, the outside aesthetic covering for the metallic material 14. Porous fabric 16 and metallic material 14 in combination make up the heat reflective side 20. FIG. 7 illustrates base panel 12, cardboard, fiberglass, or a suitable material. FIG. 7 also shows the finished surface 18 paint or fabric, the inside covering of shade 10. A plurality of pleated panels 26 make up shade 10. The layering illustrated in FIG. 7, when structured as a single unit constitutes the assemblage of shade 10.

Figure 1:
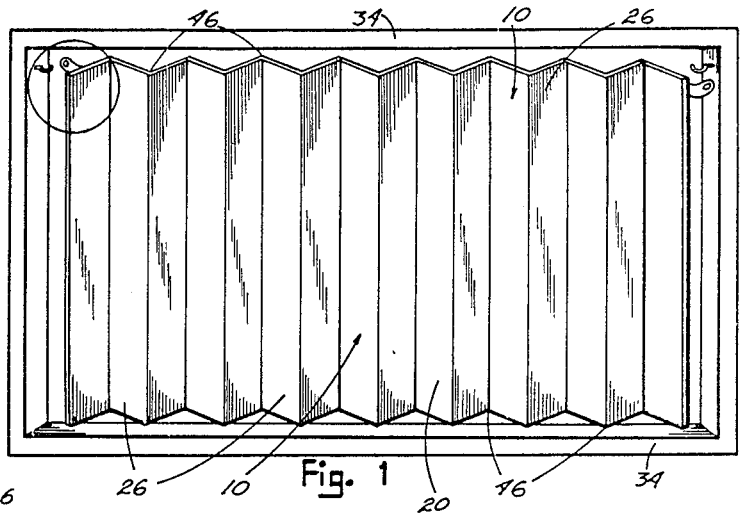
FIG. 1 shows the shade in a frontal view with the panels partially extended as they would be in use and the straps are shown on either upper end.

The installed shade 10 in window frame 34 in FIG. 1, shows shade 10 with finished surface, paint or fabric 18 inside for room cooling. Shade 10 is reversible and can be turned around so porous fabric 16 and metallic material 14, which make up heat reflective side 20, can be faced inside for room heat retention.

Figure 1A:
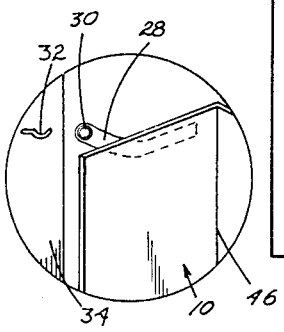
FIG. 1A illustrates a closeup of an end panel with attachment strap ready for connecting to a window hook mounted on the window frame to retain the shade in the window.

Shade 10 is fastened to fit window frame 34 by straps 28 attached to window hooks 32 as seen in FIG. 1A.

Figure 2:
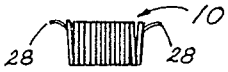
FIG. 2 shows a top view of the shade in its folded position with the straps shown on the ends.

Top plan views of shade 10 are shown with the shade panels fully compressed in FIG. 2, the shade partly opened in FIG. 3, and fully extended in FIG. 4.

Straps 28 can be seen at the ends of shade 10. In FIG. 5, a vertical illustration of the fully compressed or folded shade 10 is shown. The positioning of straps 28 upwardly on the outside wall of the end panels of shade 10 can be seen. Straps 28 may be attached in a variety of positions on shade 10 depending on window hooking requirements.

FIG. 6 shows shade 10 fully extended in a vertical view from heat reflective side 20.

An enlargement of an end panel and strap 28 positioned for hooking to hook 32 on window frame 34 is shown in FIG. 1A. The enlargement of FIG. 1A also illustrates fold hinge 46 which reinforces the fold edges of the various embodiments of shade 10.

FIG. 7 illustrate the components of shade 10 in sections 16, 14, 12, and 18 as previously herein described. The arrows show direction of assembly.

FIG. 9 illustrates two shades 10 positioned for fastening together by upper and lower panel attachment ends 40 using panel attachment snaps on end panels 40 with hinge 42. In FIG. 10, the two shades 10 are shown connected to function as a single shade. The connecting arrangement with two contacting adjacent end panels 40 is illustrated using build-in attachment snaps 38 as shown in FIG. 8. Many shades 10 may be daisychained to fit longer windows as needed with hinge 42 and using build-in attachment snaps 38.

The pleated sections 26 of shade 10 shown in FIG. 9 and 10, illustrates a solid finished surface, paint or fabric, 18 on the left hand side as positioned in the drawings. Pleated sections 26 structured with a finish of light perforations 44 is shown on the right hand side of FIG. 9 and 10. Light perforations 44 allow light to pass through shade 10 to prevent darkening of a room when shade 10 is used.

In FIG. 11, shade 10 is shown in use in window frame 34 on the sunny side of building 36. Heat reflective side 20 of shade 10 is shown deflecting heat rays 22 which are being emitted directly from sun. The radiant heat rays 22 are prevented from passing through shade 10 and building 36 is kept considerably cooler by the reflective structure of the heat insulator window shade constituting the present invention.

Although I have described in detail the preferred embodiments of my invention in the specification, it is to be understood that modifications to the invention may be made in design and structure which do not exceed the intended scope of the appended claims.

I claim:

1. A fold-out, reversible, portable heat reflective window shade comprising:

a base panel;

said base panel formed by foldable hinged substantially rectangular panels producing a single pleated window shade having opposing side surfaces;

a reflective material affixed to at least one of said side surfaces of said base panel;

a decorative covering attached to at least one of said side surfaces;

a plurality of first snap-elements affixed to the endmost panels of said base panel; at least one straplike hinge member having first and second ends;

second snap elements located on each of said first and second ends, said first and second snap elements being engageable;

a second snap element on one of said first and second ends engaging a respective first snap element, thereby attaching said hinge member to said base panel;

said second snap element on the other of said first and second ends being engagable with a second shade whereby said hinge members are adapted to connect a plurality of shades in series;

means for attaching said window shade to a building window frame.

2. The fold-out window shade as claimed in claim 1 wherein said decorative covering is affixed to said reflective material.

3. The fold-out window shade as claimed in claim 2 wherein said decorative covering being porous.

4. The fold-out window shade as claimed in claim 1 wherein said means for attaching said window shade to a building window frame includes straps affixed to terminal end of said window shade with said straps each having an eyelet in the free end sized to engage window hooks in said building window frame.

5. A fold-out, reversible, portable heat reflective window shade comprising:

a base panel;

said base panel formed by foldable hinged substantially rectangular panels producing a single pleated window shade having opposing side surfaces;

a reflective material affixed to at least one of said side surfaces of said base panel;

a decorative covering attached to at least one of said side surfaces;

a plurality of first snap-elements affixed to the endmost panels of said base panel; at least one straplike hinge member having first and second ends;

second snap elements located on each of said first and second ends, said first and second snap elements being engageable;

a second snap element on one of said first and second ends engaging a respective first snap element, thereby attaching said hinge member to said base panel;

said second snap element on the other of said first and second ends being engagable with a second shade whereby said hinge members are adapted to connect a plurality of shades in series;

means for attaching said window shade to a building window frame;

a plurality of perfor ations through said base panel and reflective material.

6. The fold-out window shade as claimed in claim 5 wherein said decorative covering is affixed to said reflective material.

7. The fold-out window shade as claimed in claim 6 wherein said decorative covering being porous.

8. The fold-out window shade as claimed in claim 5 wherein said means for attaching said window shade to a building window frame includes straps affixed to terminal end of said window shade with said straps each having an eyelet in the free end sized to engage window hooks in said building window frame.

* * * * *